US011651918B2

(12) United States Patent
Carlson et al.

(10) Patent No.: US 11,651,918 B2
(45) Date of Patent: May 16, 2023

(54) SENSING PROPERTIES OF SWITCHING DEVICES USING BACK EMF MEASUREMENTS

(71) Applicant: Rockwell Automation Technologies, Inc., Mayfield Heights, OH (US)

(72) Inventors: Andrew E. Carlson, Franklin, WI (US); Kyle B. Adkins, Oak Creek, WI (US)

(73) Assignee: Rockwell Automation Technologies, Inc., Mayfield Heights, OH (US)

( * ) Notice: Subject to any disclaimer, the term of this patent is extended or adjusted under 35 U.S.C. 154(b) by 48 days.

(21) Appl. No.: 16/902,899

(22) Filed: Jun. 16, 2020

(65) Prior Publication Data

US 2021/0391132 A1 Dec. 16, 2021

(51) Int. Cl.
*H01H 47/00* (2006.01)

(52) U.S. Cl.
CPC ..... *H01H 47/002* (2013.01)

(58) Field of Classification Search
CPC ..... H01H 47/00; H01H 47/02; H01H 47/002; H01H 47/004; H01H 47/005; H01H 47/14; H01H 47/18; H01H 47/20; H01H 47/22; H01H 47/223; H01H 47/32; H01H 47/325; H01H 2047/003; H01H 2047/006; H01H 2047/009; H01H 2047/046; H01H 50/00; H01H 50/002; H01H 50/18; H02P 6/00; H02P 6/182; G01R 31/327; G01R 31/3272; G01R 31/3275; G01R 31/3278

USPC .... 361/2–4, 6, 78, 83, 86, 88, 89, 91.3, 114, 361/115, 133, 134, 139, 157, 159, 160, 361/166, 170, 183, 185, 191, 195, 202, 361/206; 324/415–424

See application file for complete search history.

(56) References Cited

U.S. PATENT DOCUMENTS

| | | | | |
|---|---|---|---|---|
| 6,233,132 | B1 * | 5/2001 | Jenski | H01H 9/56 361/152 |
| 9,506,992 | B2 * | 11/2016 | Baraszu | G01R 31/3277 |
| 2008/0074215 | A1 | 3/2008 | Zhou et al. | |
| 2008/0157777 | A1 * | 7/2008 | Yamabe | G01R 31/3648 324/426 |
| 2013/0103334 | A1 * | 4/2013 | Delbaere | G01R 19/0046 702/57 |

* cited by examiner

*Primary Examiner* — Thienvu V Tran
*Assistant Examiner* — Carlos O Rivera-Perez
(74) *Attorney, Agent, or Firm* — Fletcher Yoder, P.C.

(57) ABSTRACT

A system may include a switching device. The switching device may include an armature that may move between a first position that electrically couples the armature to a first contact and a second position that electrically couples the armature to a second contact. The switching device may also include a coil that may receive a voltage that magnetizes a core, thereby causing the armature to move from the first position to the second position. The system may also include a control system that may monitor a voltage waveform associated with the coil during an open operation of the switching device.

20 Claims, 6 Drawing Sheets

SENSING PROPERTIES OF SWITCHING DEVICES USING BACK EMF MEASUREMENTS

BACKGROUND

The present disclosure relates generally to switching devices, and more particularly to operation and configuration of the switching devices. Switching devices are generally used throughout industrial, commercial, material handling, process and manufacturing settings, to mention only a few. As used herein, "switching device" is generally intended to describe any electromechanical switching device, such as mechanical switching devices (e.g., a contactor, a relay, air break devices, and controlled atmosphere devices) or solid-state devices (e.g., a silicon-controlled rectifier (SCR)). More specifically, switching devices generally open to disconnect electric power from a load and close to connect electric power to the load. For example, switching devices may connect and disconnect three-phase electric power to an electric motor.

As the switching devices open or close, electric power may be discharged as an electric arc and/or cause current oscillations to be supplied to the load, which may result in torque oscillations. Over time, the switching devices begin to operate slightly differently due to contact wear and other conditions. As such, systems and methods for monitoring changes in the operations of the switching devices may be useful.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

BRIEF DESCRIPTION

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

In one embodiment, a system may include a switching device. The switching device may include an armature that may move between a first position that electrically couples the armature to a first contact and a second position that electrically couples the armature to a second contact. The switching device may also include a coil that may receive a voltage that magnetizes a core, thereby causing the armature to move from the first position to the second position. The system may also include a control system that may monitor a voltage waveform associated with the coil during an open operation of the switching device.

In another embodiment, a method may include receiving, via circuitry, a first back electromotive force (EMF) waveform associated with a coil of a switching device during an open operation. The method may also include determining, via the circuitry, a change in the first back EMF waveform based on a second back EMF waveform. The method may then involve sending, via the circuitry, a notification indicative of an operating condition of the switching device to a computing device in response to the change being greater than a threshold.

In yet another embodiment, a non-transitory computer-readable medium comprising computer-executable instructions that, when executed, may cause at least one processor to perform operations that may include receiving coil voltage data associated with a coil of a switching device during an open operation. The operations may also include determining an open timing interval based the coil voltage data and sending one or more control signals to one or more components based on the open timing interval.

DRAWINGS

These and other features, aspects, and advantages of the present disclosure will become better understood when the following detailed description is read with reference to the accompanying drawings in which like characters represent like parts throughout the drawings, wherein.

Figure 10:
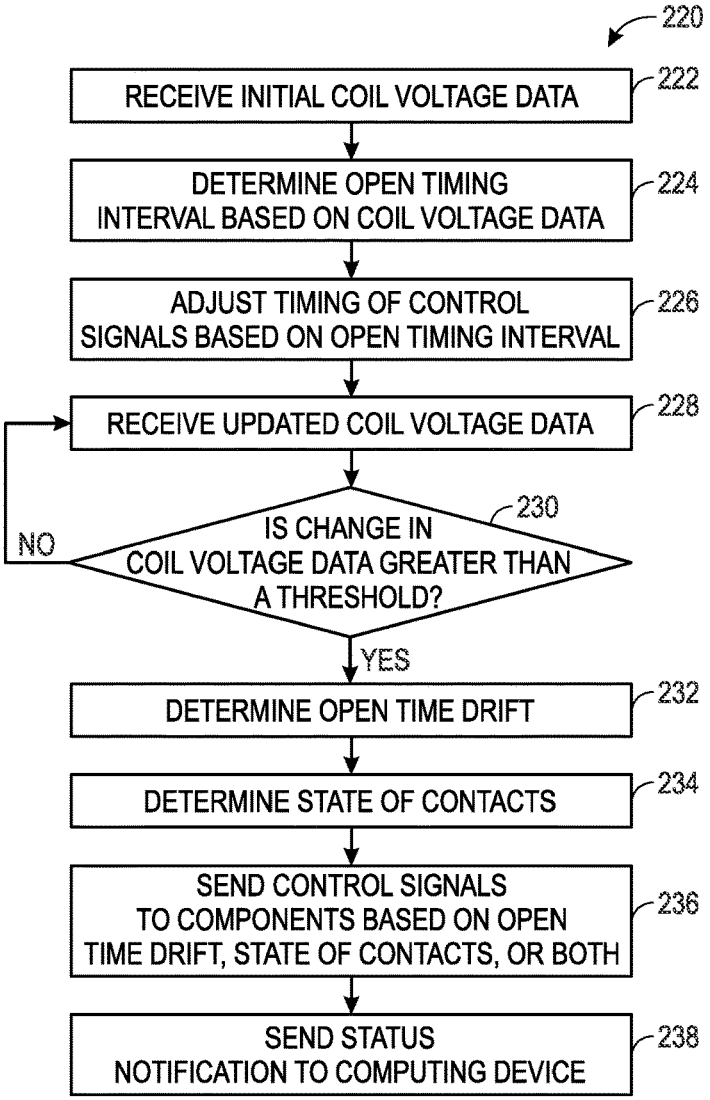
Figure 11:
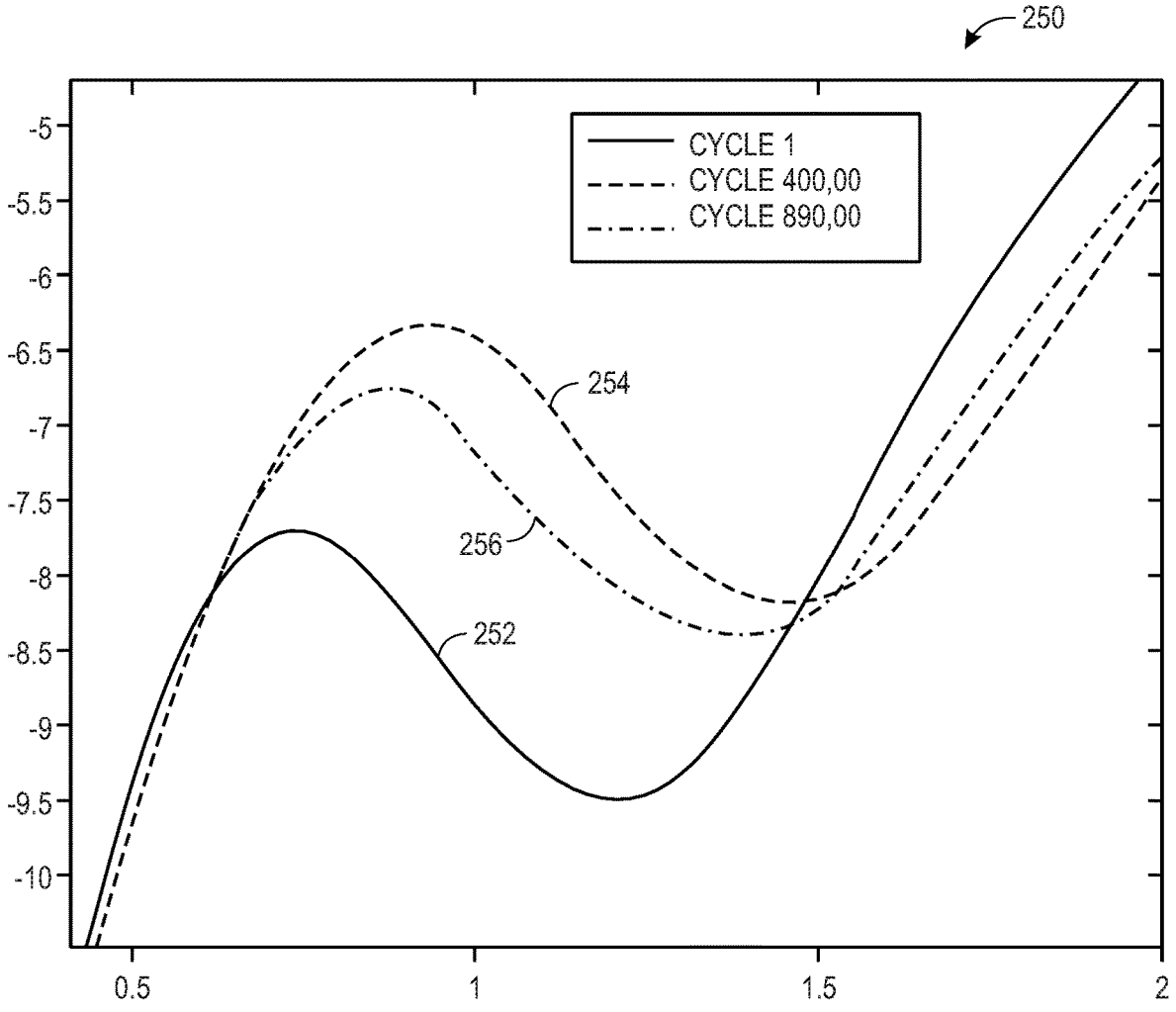

FIG. 10 illustrates a voltage over time graph that depicts a relationship between measured back electromotive force (EMF) properties of a switching device during a switching operation over a number of cycles of operations, in accordance with an embodiment; and FIG. 11 illustrates a graph that presents changes in measured back EMF properties for a switching device over a number of cycles, in accordance with an embodiment.

DETAILED DESCRIPTION

One or more specific embodiments of the present disclosure will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," "the," and "said" are intended to mean that there are one or more of the elements. The terms "comprising," "including," and "having" are intended to be inclusive and mean that there may be additional elements other than the listed elements.

As described above, switching devices are used in various implementations, such as industrial, commercial, material handling, manufacturing, power conversion, and/or power distribution, to connect and/or disconnect electric power from a load. For example, a number of switching devices may be used to control operations, monitor conditions, and perform other operations related to various equipment in an industrial automation system. As such, the switching devices may be used to coordinate operations across a number of device.

With the foregoing in mind, it should be noted that the open operation of the switching device generally depends on a coil current and a core flux of a coil that induces a magnetic field in the switching device. Over time (e.g., cycles of operation), the back electromotive force (EMF) waveform or coil voltage may change as the contacts of the switching devices wear, as a core of the coil saturates, as hysteresis effects increase, and the like. In some embodiments, a system for monitoring the change in the back EMF of the switching device during open operations may provide insight into the wear or life of the switching device. In addition, the measured back EMF may also provide insight into how much time that the switching device may take to open. As such, a number of switching devices may be coordinated in a such a fashion to precisely open or change states within microseconds of desired times. Additional details with regard to coordinating the operations and monitoring of open operations in switching devices will be described below with reference to FIGS. 1-10.

Figure 1:
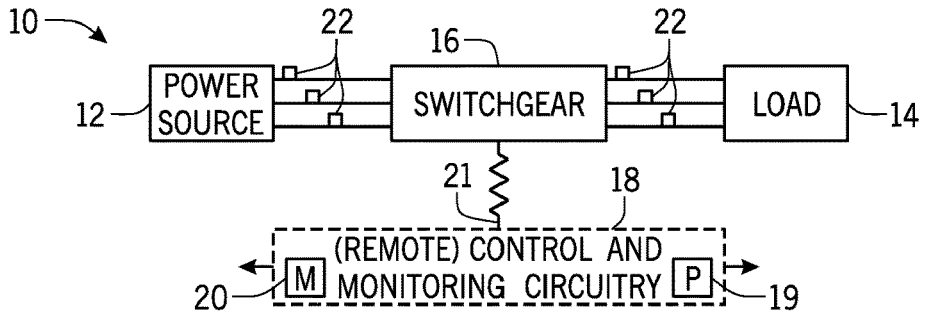
FIG. 1 is a diagrammatical representation of a set of switching devices to provide power to an electrical load, in accordance with an embodiment.

By way of introduction, FIG. 1 depicts a system 10 that includes a power source 12, a load 14, and switchgear 16, which includes one or more switching devices that may be controlled using the techniques described herein. In the depicted embodiment, the switchgear 16 may selectively connect and/or disconnect three-phase electric power output by the power source 12 to the load 14, which may be an electric motor or any other powered device. In this manner, electrical power flows from the power source 12 to the load 14. For example, switching devices in the switchgear 16 may close to connect electric power to the load 14. On the other hand, the switching devices in the switchgear 16 may open to disconnect electric power from the load 14. In some embodiments, the power source 12 may be an electrical grid.

It should be noted that the three-phase implementation described herein is not intended to be limiting. More specifically, certain aspects of the disclosed techniques may be employed on single-phase circuitry and/or for applications other than power an electric motor. Additionally, it should be noted that in some embodiments, energy may flow from the source 12 to the load 14. In other embodiments energy may flow from the load 14 to the source 12 (e.g., a wind turbine or another generator). More specifically, in some embodiments, energy flow from the load 14 to the source 12 may transiently occur, for example, when overhauling a motor.

In some embodiments, operation of the switchgear 16 (e.g., opening or closing of switching devices) may be controlled by control and monitoring circuitry 18. More specifically, the control and monitoring circuitry 18 may instruct the switchgear 16 to connect or disconnect electric power. Accordingly, the control and monitoring circuitry 18 may include one or more processors 19 and memory 20. More specifically, as will be described in more detail below, the memory 20 may be a tangible, non-transitory, computer-readable medium that stores instructions, which when executed by the one or more processors 19 perform various processes described. It should be noted that non-transitory merely indicates that the media is tangible and not a signal. Many different algorithms and control strategies may be stored in the memory and implemented by the processor 19, and these will typically depend upon the nature of the load, the anticipated mechanical and electrical behavior of the load, the particular implementation, behavior of the switching devices, and so forth.

Additionally, as depicted, the control and monitoring circuitry 18 may be remote from the switchgear 16. In other words, the control and monitoring circuitry 18 may be communicatively coupled to the switchgear 16 via a network 21. In some embodiments, the network 21 may utilize various communication protocols such as DeviceNet, Profibus, Modbus, and Ethernet, to mention only a few. For example, to transmit signals between the control and monitoring circuitry 18 may utilize the network 21 to send make and/or break instructions to the switchgear 16. The network 21 may also communicatively couple the control and monitoring circuitry 18 to other parts of the system 10, such as other control circuitry or a human-machine-interface (not separately depicted). Additionally, the control and monitoring circuitry 18 may be included in the switchgear 16 or directly coupled to the switchgear, for example, via a serial cable.

Furthermore, as depicted, the electric power input to the switchgear 16 and output from the switchgear 16 may be monitored by sensors 22. More specifically, the sensors 22 may monitor (e.g., measure) the characteristics (e.g., voltage or current) of the electric power. Accordingly, the sensors 22 may include voltage sensors and current sensors. These sensors may alternatively be modeled or calculated values determined based on other measurements (e.g., virtual sensors). Many other sensors and input devices may be used, depending upon the parameters available and the application. Additionally, the characteristics of the electric power measured by the sensors 22 may be communicated to the control and monitoring circuitry 18 and used as the basis for algorithmic computation and generation of waveforms (e.g., voltage waveforms or current waveforms) that depict the electric power. More specifically, the waveforms generated based on input the sensors 22 monitoring the electric power input into the switchgear 16 may be used to define the control of the switching devices, for example, by reducing electrical arcing when the switching devices open or close. The waveforms generated based on the sensors 22 monitoring the electric power output from the switchgear 16 and supplied to the load 14 may be used in a feedback loop to, for example, monitor conditions of the load 14.

Figure 2:
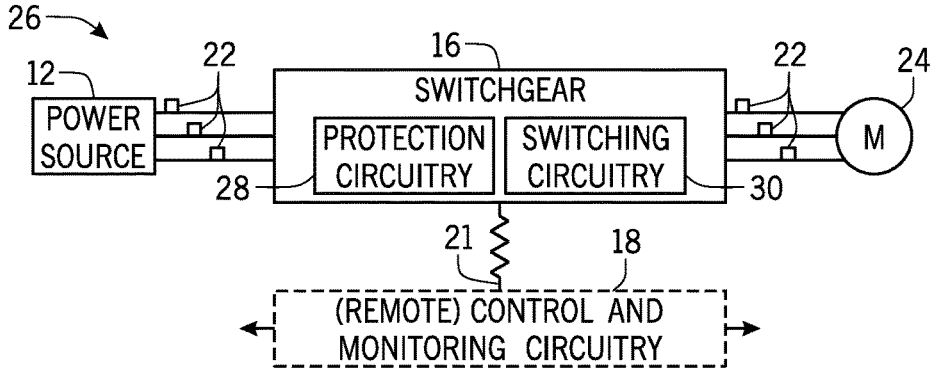
FIG. 2 is a similar diagrammatical representation of a set of switching devices to provide power to an electrical motor, in accordance with an embodiment.
Figure 3:
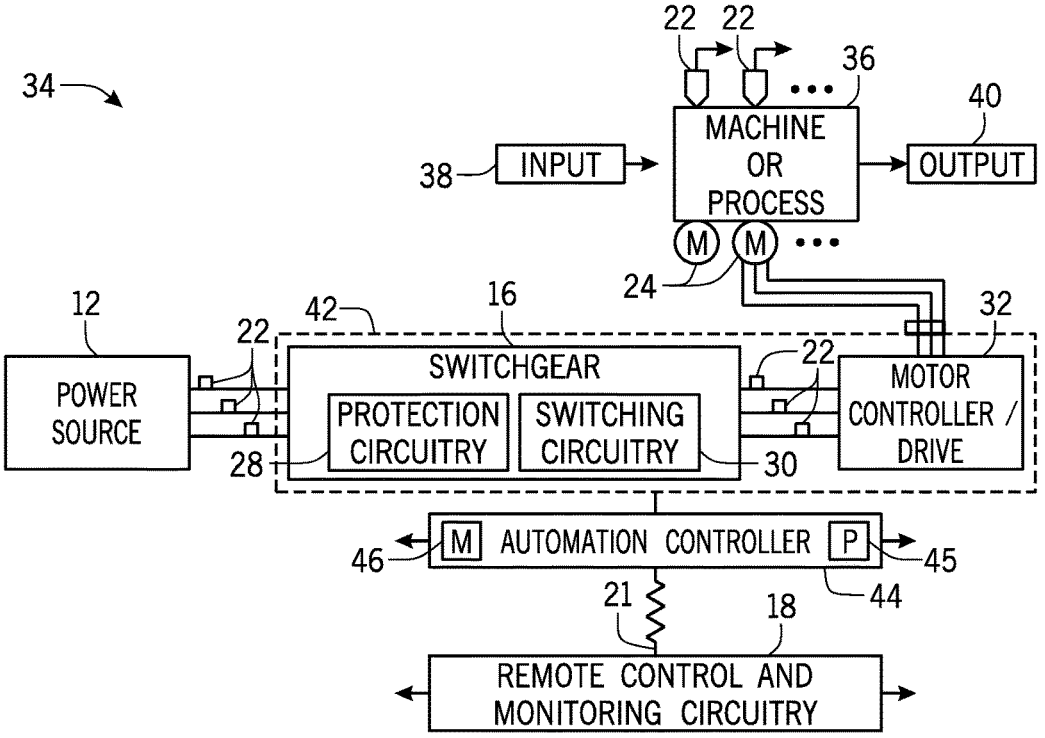
FIG. 3 is a similar diagrammatical representation of a set of switching devices to provide power to an electrical motor, in accordance with an embodiment.

As described above, the switchgear 16 may connect and/or disconnect electric power from various types of loads 14, such as an electric motor 24 included in the motor system 26 depicted in FIG. 2. As depicted, the switchgear 16 may connect and/or disconnect the power source 12 from the electric motor 24, such as during startup and shut down. Additionally, as depicted, the switchgear 16 will typically include or function with protection circuitry 28 and the actual switching circuitry 30 that makes and breaks connections between the power source and the motor windings. More specifically, the protection circuitry 28 may include fuses and/or circuit breakers, and the switching circuitry 30 will typically include relays, contactors, and/or solid-state switches (e.g., SCRs, MOSFETs, IGBTs, and/or GTOs), such as within specific types of assembled equipment (e.g., motor starters).

More specifically, the switching devices included in the protection circuitry 28 may disconnect the power source 12 from the electric motor 24 when an overload, a short circuit condition, or any other unwanted condition is detected. Such control may be based on the un-instructed operation of the device (e.g., due to heating, detection of excessive current, and/or internal fault), or the control and monitoring circuitry 18 may instruct the switching devices (e.g., contactors or relays) included in the switching circuitry 30 to open or close. For example, the switching circuitry 30 may include one (e.g., a three-phase contactor) or more contactors (e.g., three or more single-pole, single current-carrying path switching devices).

Accordingly, to start the electric motor 24, the control and monitoring circuitry 18 may instruct the one or more contactors in the switching circuitry 30 to close individually, together, or in a sequential manner. On the other hand, to stop the electric motor 24, the control and monitoring circuitry 18 may instruct the one or more contactors in the switching circuitry 30 to open individually, together, or in a sequential manner. When the one or more contactors are closed, electric power from the power source 12 is connected to the electric motor 24 or adjusted and, when the one or more contactors are open, the electric power is removed from the electric motor 24 or adjusted. Other circuits in the system may provide controlled waveforms that regulate operation of the motor (e.g., motor drives, automation controllers, etc.), such as based upon movement of articles or manufacture, pressures, temperatures, and so forth. Such control may be based on varying the frequency of power waveforms to produce a controlled speed of the motor.

In some embodiments, the control and monitoring circuitry 18 may determine when to open or close the one or more contactors based at least in part on the characteristics of the electric power (e.g., voltage, current, or frequency) measured by the sensors 22. Additionally, the control and monitoring circuitry 18 may receive an instruction to open or close the one or more contactors in the switching circuitry 30 from another part of the motor system 26, for example, via the network 21.

In addition to using the switchgear 16 to connect or disconnect electric power directly from the electric motor 24, the switchgear 16 may connect or disconnect electric power from a motor controller/drive 32 included in a machine or process system 34. More specifically, the system 34 includes a machine or process 36 that receives an input 38 and produces an output 40.

To facilitate producing the output 40, the machine or process 36 may include various actuators (e.g., electric motors 24) and sensors 22. As depicted, one of the electric motors 24 is controlled by the motor controller/drive 32. More specifically, the motor controller/drive 32 may control the velocity (e.g., linear and/or rotational), torque, and/or position of the electric motor 24. Accordingly, as used herein, the motor controller/drive 32 may include a motor starter (e.g., a wye-delta starter), a soft starter, a motor drive (e.g., a frequency converter), a motor controller, or any other desired motor powering device. Additionally, since the switchgear 16 may selectively connect or disconnect electric power from the motor controller/drive 32, the switchgear 16 may indirectly connect or disconnect electric power from the electric motor 24.

As used herein, the "switchgear/control circuitry" 42 is used to generally refer to the switchgear 16 and the motor controller/drive 32. As depicted, the switchgear/control circuitry 42 is communicatively coupled to a controller 44 (e.g., an automation controller. More specifically, the controller 44 may be a programmable logic controller (PLC) that locally (or remotely) controls operation of the switchgear/control circuitry 42. For example, the controller 44 may instruct the motor controller/driver 32 regarding a desired velocity of the electric motor 24. Additionally, the controller 44 may instruct the switchgear 16 to connect or disconnect electric power. Accordingly, the controller 44 may include one or more processor 45 and memory 46. More specifically, the memory 46 may be a tangible non-transitory computer-readable medium on which instructions are stored. As will be described in more detail below, the computer-readable instructions may be configured to perform various processes described when executed by the one or more processor 45. In some embodiments, the controller 44 may also be included within the switchgear/control circuitry 42.

Furthermore, the controller 44 may be coupled to other parts of the machine or process system 34 via the network 21. For example, as depicted, the controller 44 is coupled to the remote control and monitoring circuitry 18 via the network 21. More specifically, the automation controller 44 may receive instructions from the remote control and monitoring circuitry 18 regarding control of the switchgear/control circuitry 42. Additionally, the controller 44 may send measurements or diagnostic information, such as the status of the electric motor 24, to the remote control and monitoring circuitry 18. In other words, the remote control and monitoring circuitry 18 may enable a user to control and monitor the machine or process 36 from a remote location.

Moreover, sensors 22 may be included throughout the machine or process system 34. More specifically, as depicted, sensors 22 may monitor electric power supplied to the switchgear 16, electric power supplied to the motor controller/drive 32, and electric power supplied to the electric motor 24. Additionally, as depicted, sensors 22 may be included to monitor the machine or process 36. For example, in a manufacturing process, sensors 22 may be included to measure speeds, torques, flow rates, pressures, the presence of items and components, or any other parameters relevant to the controlled process or machine.

As described above, the sensors 22 may feedback information gathered regarding the switchgear/control circuitry 42, the motor 24, and/or the machine or process 36 to the control and monitoring circuitry 18 in a feedback loop. More specifically, the sensors 22 may provide the gathered information to the automation controller 44 and the automation controller 44 may relay the information to the remote control and monitoring circuitry 18. Additionally, the sensors 22 may provide the gathered information directly to the remote control and monitoring circuitry 18, for example via the network 21.

To facilitate operation of the machine or process 36, the electric motor 24 converts electric power to provide mechanical power. To help illustrate, an electric motor 24 may provide mechanical power to various devices. For example, the electric motor 24 may provide mechanical power to a fan, a conveyer belt, a pump, a chiller system, and various other types of loads that may benefit from the advances proposed.

As discussed in the above examples, the switchgear/control circuitry 42 may control operation of a load 14 (e.g., electric motor 24) by controlling electric power supplied to the load 14. For example, switching devices (e.g., contactors) in the switchgear/control circuitry 42 may be closed to supply electric power to the load 14 and opened to disconnect electric power from the load 14.

Figure 4:
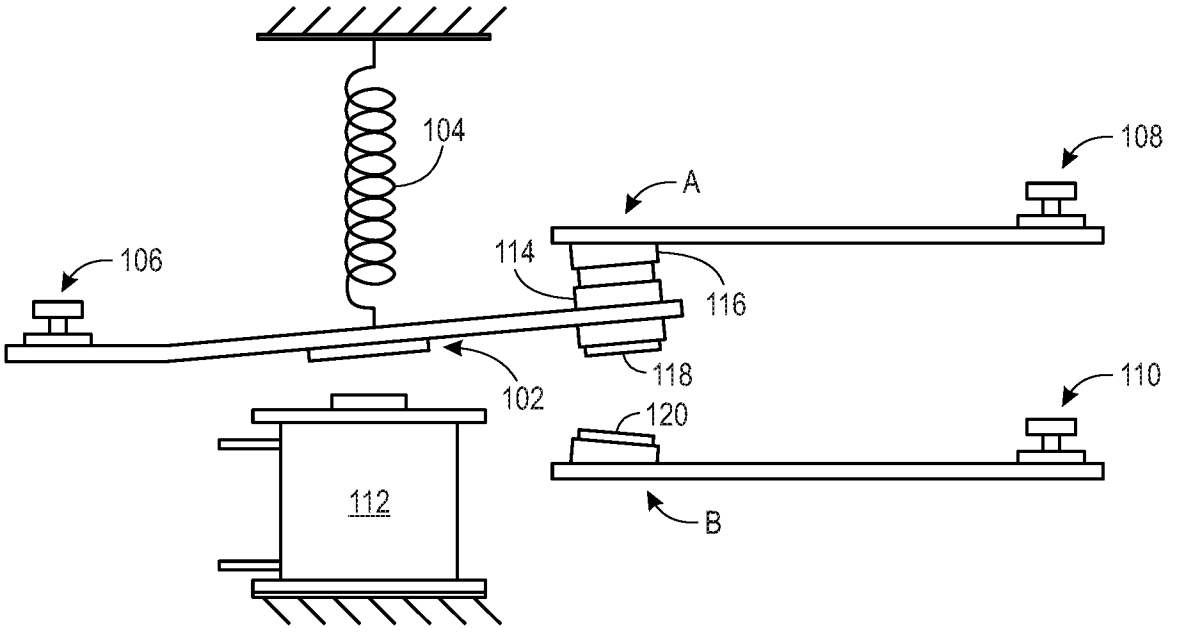
FIG. 4 is a system view of an example single-pole, single current-carrying path relay device, in accordance with an embodiment.

By way of example, the switching device may include a relay device 100 that is composed of components illustrated in FIG. 4, some of which correspond to the components of the switching device described above. As shown in FIG. 4, the relay device 100 may include an armature 102 that is coupled to a spring 104. The armature 102 may have a common contact 106 that may be coupled to a part of an electrical circuit. The armature 102 may electrically couple the common contact 106 to a contact 108 or to a contact 110 depending on a state (e.g., energized) of the relay device 100. For example, when a relay coil 112 of the relay device 100 is not energized or does not receive voltage from a driving circuit, the armature 102 is positioned such that the common contact 106 and the contact 108 are electrically coupled to each other. When the relay coil 112 receives a driving voltage, the relay coil 112 magnetizes and attracts the armature 102 to itself, thereby connecting the contact 110 to the common contact 106.

The electrical connections between the common contact 106 and the contacts 108 and 110 are made via contacts 114 and 116 and contacts 118 and 120, respectively. Over time, as the contacts 114 and 116 and the contacts 118 and 120 strike against each other, the conductive material of the contacts 114, 116, 118, and 120 may begin to wear.

Moreover, the relay coil 112 may include a core that maintains a core flux during the operation of the relay device 100. That is, as the armature 102 moves between connecting to the contact 108 and the contact 110, and vice-versa, a magnetic flux may be generated in a core of the relay coil 112 and/or the armature 102. This magnetic flux may be related to the core flux of the relay coil 112 and may change over time as the relay device operates.

Figure 5:
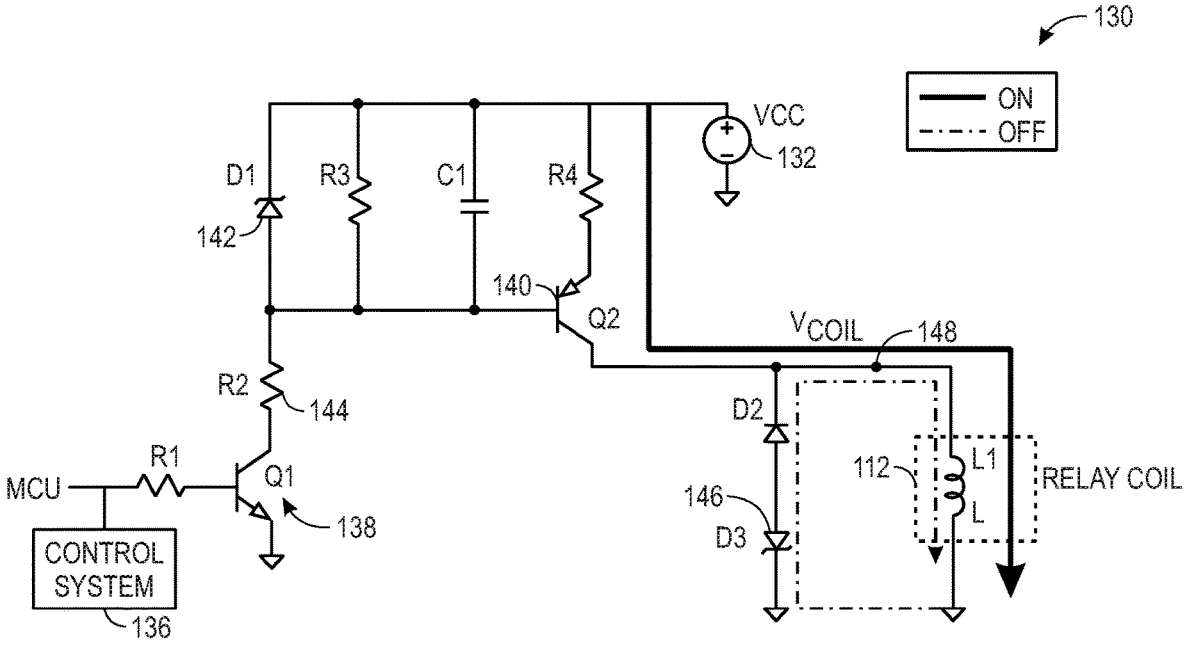
FIG. 5 is a circuit diagram for providing monitoring coil voltage data (e.g., back electromotive force data) associated with a coil of a switching device, in accordance with an embodiment.

With this in mind, FIG. 5 illustrates an example circuit 130 of the relay device 100 described above. Referring to FIG. 5, the circuit 130 may include a voltage source 132 that may be used to drive the relay coil 112. The voltage source 132 may output a voltage that causes the relay coil 112 to magnetize and thus generates a force to move the armature 102. In some embodiments, a control system 136 may provide a gate signal to a switching device 138 (e.g., transistor), which may couple a gate of a switching device 140 to ground, thereby causing the switching device 140 to close. As a result, the relay coil 112 may be energized via the voltage source 132.

In some embodiments, a Zener diode 142 may be coupled between to the gate of the switching device 140, as shown in FIG. 5. The Zener diode 142 may be a semiconductor device that permits current to flow in a forward or reverse direction. In addition, the Zener diode 142 may clamp or limit the voltage provided to a resistor 144. In same manner, a Zener diode 146 may be used to clamp or limit a voltage provided to the relay coil 112.

As shown in FIG. 5, when the relay coil 112 is energized (e.g., on), the switching device 140 closes and current conducts from the voltage source 132 to the relay coil 112 via the switching device 140. On the other hand, when the relay coil 112 opens (e.g., off), the switching device 140 opens and current dissipates through the relay coil 112 and the Zener diode 146.

Figure 6:
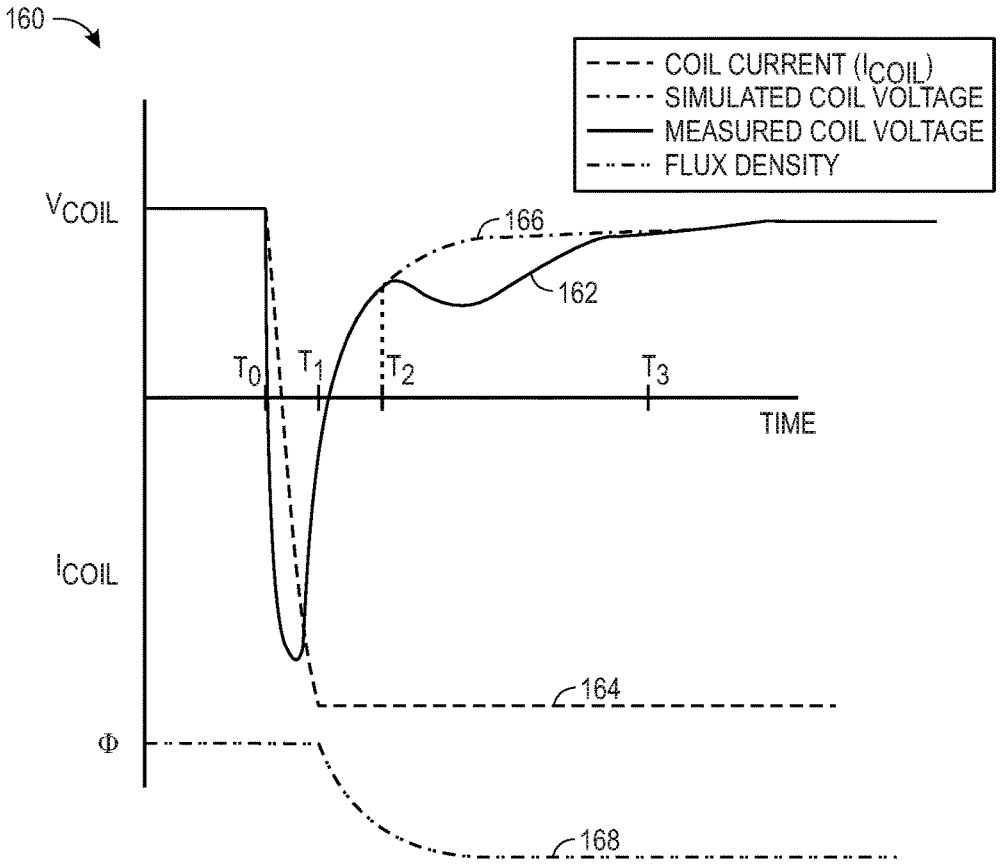
FIG. 6 is a coil voltage/current/flux-time graph that depicts a coil voltage, a coil current, and a coil's magnetic flux of a coil in a switching device during a switching operation, in accordance with an embodiment.

With this in mind, FIG. 6 illustrates a graph 160 that illustrates various properties of the relay coil 112 during an open operation. At time t0, a coil voltage 162 (e.g., measured at node 148) may decrease rapidly due to the switching device 140 opening and the flux changing with the moving armature 102. In addition to the coil voltage 162 decreasing, a coil current 164 decreases as well. In an ideal relay coil 112, the coil voltage recovers as shown in line 166, which represents the flux decay when the armature 102 is held closed. However, due to the presence of residual flux in the core of the relay coil 112, the measured coil voltage 162 may not recover as predicted by the line 166. That is, at time t1, when the coil current 164 collapses to zero, a flux density 168 of the core of the relay coil 112 is still changing. As a result, a lag is observed between the coil current reaching zero and the flux density 168 reaching zero. This lag causes the measured coil voltage 162 to decrease at time t2 before recovering like the line 166. In other words, hysteresis and/or eddy currents generated in the core material of the relay coil 112 may cause the residual flux density 168 to remain when a magnetizing force (e.g., coil current 164) in the relay coil 112 is removed. The flux density 168 coupled with a mechanical movement of the armature 102 generates the voltage dip illustrated at time t2.

In this way, the flux density 168 influences the movement of the armature 102. Moreover, as contacts erode, the time in which the armature 102 starts to move and change the timing of when the contacts 114 and 118 changes states changes. As such, monitoring the timing of the movement of the armature 102 and the contacts 1114 and 118 may be directly related to the wear of various mechanical components (e.g., contacts, armature, spring) of the relay device 100. Moreover, by monitoring the voltage properties of the relay coil during an open operation, different relay devices may be calibrated to provide a more consistent open operation across various relay devices.

Figure 7:
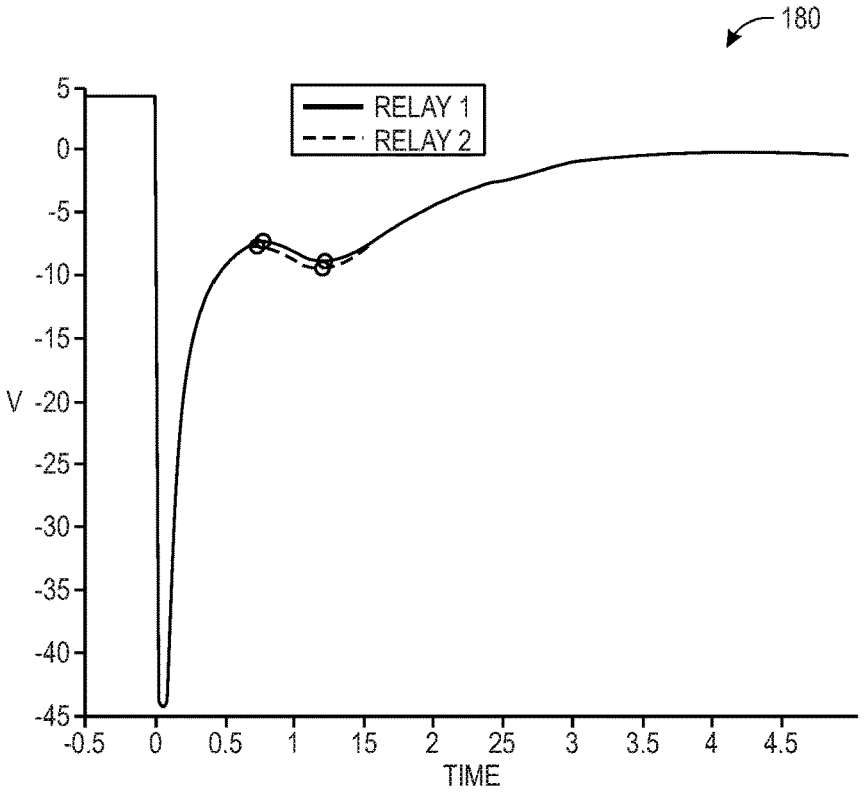
FIG. 7 is a voltage-time graph that depicts the voltage across two coils of two switching devices during a switching operation, in accordance with an embodiment.
Figure 8:
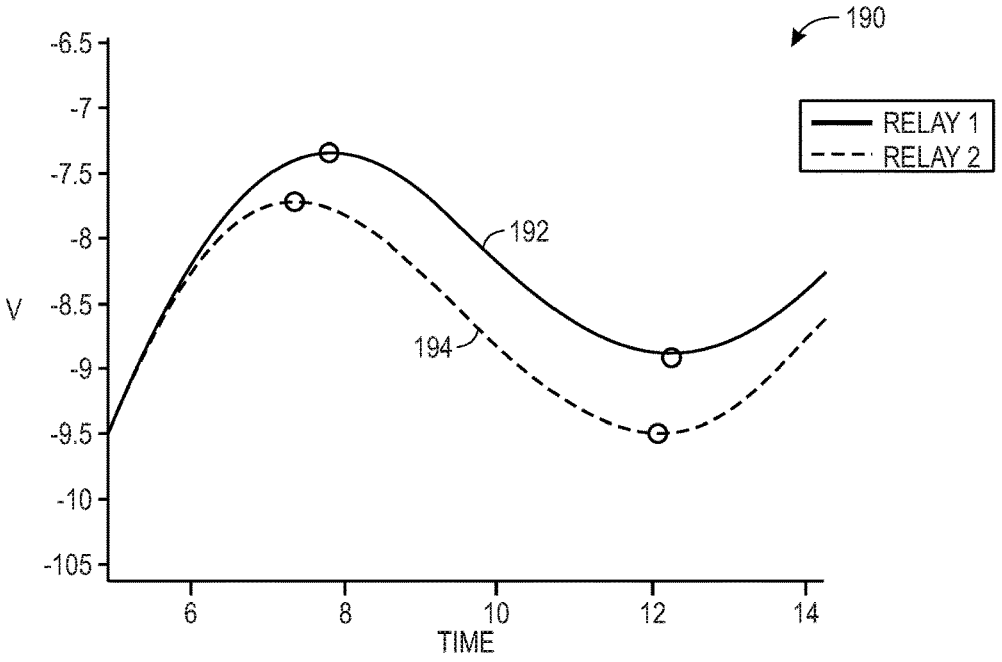
FIG. 8 is a block diagram of a control system that may be used to monitor a coil voltage, in accordance with an embodiment.

For example, FIGS. 7 and 8 illustrate a graph 180 and a graph 190 that tracks voltage over time during an open operation for two relay devices. The graph 190 depicts the voltage over time properties of the two relay devices in a more detail at a more granular scale as compared to the graph 180. Referring to the graph 190, a first relay voltage 192 associated with a first coil voltage (e.g., at node 148) or back EMF voltage of the first relay device 192 and a second relay voltage 194 associated with a second coil voltage (e.g., at node 148) or back EMF voltage of the second relay device 194 during open operations may be closely analyzed. As shown in FIG. 8, the second relay voltage 194 may have a lower maximum value and a lower minimum value during a portion of the time that the respective coil voltages stabilize, as compared to the first relay voltage 192. That is, after the open operation is performed by the respective relay device, a control system may track each respective coil voltage until it changes its trajectory (e.g., rising or falling) to measure its maximum voltage value and its minimum voltage value and the correspond times at which those voltages were recorded.

Based on maximum and minimum voltage values, the control system 136 or any suitable control system may coordinate the operations of different relay devices, such that the detected maximum voltage values, the detected minimum voltage values, or both occur at the same time. For example, the control system 136 may incorporate a slight delay when performing an open operation for the second relay device represented in FIG. 8 to cause the second relay voltage 194 to reach its maximum value (e.g., during the transition period after the open operation) at substantially the same time as the first relay voltage 192 reaches its maximum value. By incorporating this time delay, the control system 136 may better equip the first relay device 192 and the second relay device 194 to open at the same time, thereby reducing chances that equipment controlled by the relay devices operate asynchronously.

Figure 9:
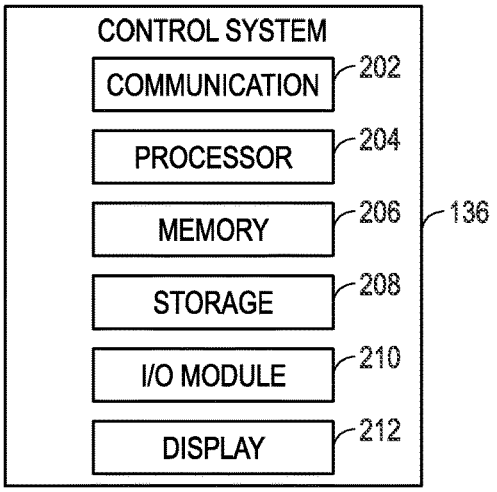
FIG. 9 is a method for controlling components based on changes to coil voltage properties over time, in accordance with an embodiment.

With the foregoing in mind, it should be noted that the control system 136 may include any suitable computing system, controller, or the like. By way of example, FIG. 9 illustrates certain components that may make up the control system 136. The control system 136 may include a communication component 202, a processor 204, a memory 206, a storage 208, input/output (I/O) ports 210, a display 212, and the like. The communication component 202 may be a wireless or wired communication component that may facilitate communication between different components within the industrial automation system, the relay device 100, or the like.

The processor 204 may be any type of computer processor or microprocessor capable of executing computer-executable code. The processor 204 may also include multiple processors that may perform the operations described below. The memory 206 and the storage 208 may be any suitable articles of manufacture that can serve as media to store processor-executable code, data, or the like. These articles of manufacture may represent computer-readable media (e.g., any suitable form of memory or storage) that may store the processor-executable code used by the processor to perform the presently disclosed techniques. The memory 206 and the storage 208 may represent non-transitory computer-readable media (e.g., any suitable form of memory or storage) that may store the processor-executable code used by the processor to perform various techniques described herein. It should be noted that non-transitory merely indicates that the media is tangible and not a signal.

The I/O ports 210 may be interfaces that may couple to other peripheral components such as input devices (e.g., keyboard, mouse), sensors, input/output (I/O) modules, and the like. The display 212 may operate to depict visualizations associated with software or executable code being processed by the processor. In one embodiment, the display may be a touch display capable of receiving inputs from a user. The display may be any suitable type of display, such as a liquid crystal display (LCD), plasma display, or an organic light emitting diode (OLED) display, for example. Additionally, in one embodiment, the display 212 may be provided in conjunction with a touch-sensitive mechanism (e.g., a touch screen) that may function as part of a control interface. It should be noted that the components described above with regard to the control system 136 are exemplary components and the control system 136 may include additional or fewer components as shown.

As discussed above, opening (e.g., breaking) and closing (e.g., making) relay devices or any type of switching device may cause certain properties of the switching devices to change over time. For example, after a number of open and close cycles, the contacts that are used to make and break electrical connections for the switching device may wear over time, weld together, and the like. With this in mind, the control system 136 may monitor the wear of the contacts and the operations of the switching device based on how the back EMF properties or coil voltage properties change over time. FIG. 10 illustrates a method 220 for controlling operations of other switching devices, monitoring wear of the switching device, and the like based on the back EMF properties of the respective switching device.

Before discussing the method 220, it should be noted that although the method 220 will be described as being performed by the control system 136, it should be understood that the method 220 may be performed by any suitable control system or computing device. In addition, although the method 220 is described in a particular order, it should be noted that the method 220 may be performed in any suitable order.

Referring now to FIG. 10, at block 222, the control system 136 may receive initial coil voltage data for a switching device. The initial coil voltage data may correspond to a voltage waveform (e.g., back EMF waveform) during an open or close operation. In some embodiments, the initial coil voltage data may be acquired during commissioning of the switching device, during acceptance testing at an industrial system, after manufacturing, or any suitable time. In any case, the initial coil voltage data may be used as a reference to gauge how the operating characteristics of the switching device changes over time. The initial coil voltage may be stored in the storage 208, a database, or any suitable storage component. By way of example, the coil voltage data may be measured at the node 148 of the example circuit 130 presented above in FIG. 5.

At block 224, the control system 136 may determine an open timing interval for the switching device based on the initial coil voltage data. The opening timing interval may correspond to an amount of time between a time in which the switching device initiates an open operation and after the armature of switching device moves to an open position. In one embodiment, the armature may complete its motion after the coil voltage stabilizes and remains at a relatively constant level (e.g., within 5%) over a period of time. By way of example, the coil voltage 162 depicted in the graph 160 of FIG. 6 may stabilize at time t3.

After determining the open timing interval for the switching device, the control system 136 may, at block 226, adjust the timing of control signals used for other switching devices based on the open timing interval. That is, if other switching devices are expected to open and/or close synchronously or according to a coordinated schedule with respect to the switching device being evaluated, the control system 136 may adjust the times in which control signals are sent to the other switching devices or to other control systems that control operations of the other switching devices based on the open timing interval of the switching device evaluated at block 222. For instance, if the open timing interval indicates that the switching device takes an additional 2-5 ms to open as compared to other switching devices, the control system 136 may add a 2-5 ms delay in sending control signals to the other switching devices to ensure that each of the switching devices operate in a synchronous fashion. In some embodiments, the timing adjustment may be implemented for the switching device being evaluated at block 224 based on the open timing interval of other switching devices.

At block 228, the control system 136 may receive updated coil voltage data for the switching device evaluated at block 222. The updated coil voltage data may be received at any suitable time after receiving the initial coil voltage data at block 222. In some embodiments, the updated coil voltage data may be received after an expiration of a certain amount of time (e.g., hours, days, weeks, years), after a number of operation cycles (e.g., 100, 1,000, 10,000, etc.) performed by the switching device, and the like.

In any case, after receiving the updated coil voltage data, the control system 136 may determine whether a change in the updated coil voltage data and the initial coil voltage data is greater than some threshold. The comparison between the two coil voltage data may include a comparison of two voltage waveforms associated with the open operations. As mentioned above, the coil voltage data or voltage waveforms during an open operation may change over time. The threshold may be related to differences between the respective waveforms, differences in maximum values, differences in minimum values, amount of time to stabilize, and the like.

For instance, FIG. 11 illustrates a graph 250 that presents how changes in measured back EMF properties (e.g., coil voltages) for a switching device over 890,000 cycles. Referring briefly to FIG. 11, back EMF waveform 252 corresponds to the operation of the switching device during its first opening operation or cycle. As shown in the graph 250, over time the back EMF waveform 252 changes to back EMF waveform 254 after 400,00 cycles. By way of operation, as the switching device operates over an initial period of time, the contacts may conform to each other's shape in such a manner to cause the movement of the armature of the switching device to change. As such, the peak voltage of the back EMF waveform 254 may be greater than the back EMF waveform 252 during the transition period of open operations that take place over a number of cycles of operation. After more cycles are performed, the back EMF waveform 254 may change again to the back EMF waveform 256. As shown in the back EMF waveform 256, after the initial period of operation (e.g., 400,000 cycles), the maximum back EMF value and minimum back EMF value may decrease. This decrease may be related to the wearing of the contact surface, changes in the magnetic properties of a core, and the like. In any case, the change of the back EMF waveforms or the coil voltage, as illustrated in FIG. 11, may trend in such a way that the maximum and minimum voltages may increase over time along with the times in which those voltages occur. As such, the change in the back EMF waveforms or the coil voltage may be representative of an amount of wear of the switching device.

Referring back to block 230, if the change between the initial coil voltage data and the updated coil voltage data is less than the threshold, the control system 136 may return to block 228 and receive updated coil voltage data at a later time, after a number of cycles, or the like. However, if the change in the coil voltage data is greater than or equal to the threshold, the control system 136 may proceed to block 232.

At block 232, the control system 136 may determine an open time drift for the switching device. That is, the control system 136 may determine a change in an amount of time for the switching device to open. That is, the control system 136 may compare the open timing interval determined at block 224 with an updated open timing interval to determine an amount of drift between the two amounts of time. In some embodiments, the open time drift may be related to a number of open operation cycles performed by the switching device.

At block 234, the control system 136 may determine a state of the contacts of the switching device. The state of the contacts may include an indication that the contacts are worn, such that conductive material deposited on the contacts has been reduced to limit the conductive properties between the contacts. In addition, the state of the contacts may include a determination as to whether the contacts are welded together. That is, by monitoring the coil voltage data, the control system 136 may determine that the contacts of the switching device are welded together if the coil voltage data (e.g., back EMF) does not change during the open operation.

After determining the open time drift, the state of the contacts, or both, the control system 136 may send control signals to other components at block 236. The control signals may correspond the devices controlled with adjusted timing signals described at block 226. In addition, the control system 136 may adjust the control signals sent to other components based on the state of the contacts. For example, if the state of the contacts indicates that the contacts are worn, the control system 136 may send a control signal to an auxiliary device or fail-safe device to ensure that the appropriate signals are transmitted to other devices.

In any case, at block 238, the control system 136 may send a status notification to a computing device, a database, a server, a cloud-computing system, or the like. The status notification may cause a visualization to be generated to provide details with regard to the change in the coil voltage data, the open time drift, the state of the contacts, and the like. In some embodiments, the status notification may include a determination of an amount of life expectancy for the switching device, an indication that the contacts are welded together, and the like. The life expectancy may be determined based on the minimum value, the maximum value, an average value, and other values associated with the back EMF waveform measured during the transition period of an open operation for the coil of the switching device. For example, as the maximum value of the back EMF waveform decreases, the life expectancy of the switching device may decrease.

In some embodiments, a historical record of the back EMF waveform for the life of another switching device or a baseline switching that corresponds to the switching device being evaluated may be stored in a database or the like. As such, the control system 136 may compare the updated coil voltage data (e.g., back EMF waveform) to other back EMF waveforms for the respective switching device to determine a current life expectancy of the respective switching device. That is, the historical record may track the back EMF waveform for the life of the switching device. As such, the control system 136 may determine a life expectancy of the switching device by tracking the recently acquired coil voltage data with the historical record. In the same manner, a historical record of maximum values and minimum values associated with the back EMF waveforms during open operations may be stored, such that the control system 136 may determine a state or condition of the switching device, the contacts of the switching device, or the like based on the updated coil voltage data.

In some embodiments, the status notification may cause the recipient computing device to automatically execute or open an application, such that the notification or any generated visualization is presented for viewing to a user. In addition, the status notification may cause the application or program stored on the recipient computing device to output or produce a visual alert (e.g., flashing light, home screen visualization), an audible alert, or the like in response to the life expectancy of the respective switching device being less than a threshold amount of time.

Technical effects of the embodiments described herein include increasing the monitoring capabilities of switching devices without adding additional hardware. That is, since the coil voltage data may be measured at the node 148 of the example circuit 130 presented above in FIG. 5, additional sensors for monitoring the armature position within the switching device may be avoided. As a result, the switching device may include more monitoring features without adding additional components that may increase the size of the switching device.

It should be noted that some switching or relay devices may include more than one coil. For example, some relay devices may have two coils, such that both coils may be used to control the movement of an armature. In these types of relay devices, one of the coils may be used to hold the armature in place after it moves to a particular position. It should be understood that the present embodiments described herein may be implemented on the deactivated coil to measure the flux or the back EMF of the relay. In this way, the additional coil that is not being used may provide an indication of the life of the relay.

It should also be noted that although certain embodiments described herein are described in the context or contacts that are part of a relay device, it should be understood that the embodiments described herein may also be implemented in suitable contactors and other switching components. Moreover, it should be noted that each of the embodiments described in various subsections herein, may be implemented independently or in conjunction with various other embodiments detailed in different subsections to achieve more efficient (e.g., power, time) and predictable devices that may have a longer lifecycle. It should also be noted that while some embodiments described herein are detailed with reference to a particular relay device or contactor described in the specification, it should be understood that these descriptions are provided for the benefit of understanding how certain techniques are implemented. Indeed, the systems and methods described herein are not limited to the specific devices employed in the descriptions above. In addition, although the monitored operations are described herein with respect to open operations, the presently disclosed techniques may also be implemented for close operations.

While only certain features of the disclosure have been illustrated and described herein, many modifications and changes will occur to those skilled in the art. It is, therefore, to be understood that the appended claims are intended to cover all such modifications and changes as fall within the true spirit of the disclosure.

The invention claimed is:

1. A system, comprising:

a switching device, comprising:

an armature configured to move between a first position that electrically couples the armature to a first contact and a second position that electrically couples the armature to a second contact;

a coil configured receive a voltage configured to magnetize a core, thereby causing the armature to move from the first position to the second position; and a control system configured to:

receive initial coil voltage data corresponding to a voltage waveform associated with the coil during a first open operation of the switching device;

receive updated coil voltage data corresponding to the voltage waveform associated with the coil during a second open operation of the switching device that occurs after a close operation of the switching device that occurred between the first open operation and the second open operation;

determine a change between the updated coil voltage data and the initial coil voltage data by:

determining a first difference between a first maximum value associated with the initial coil voltage data and a second maximum value associated with the updated coil voltage data during the first open operation and the second open operation, respectively; and determining a second difference between a first minimum value associated with the initial coil voltage data and a second minimum value associated with the updated coil voltage data during the first open operation and the second open operation, respectively; and send a notification indicative of a state of the switching device to an additional control system in response to the first difference being greater than a first threshold and the second difference being greater than a second threshold, wherein the additional control system is configured to send a control signal to an additional switching device based on the state of the switching device, wherein the control signal is configured to adjust an open time interval of the additional switching device.

2. The system of claim 1, wherein the voltage waveform corresponds to a back electromotive force (EMF) of the coil.

3. The system of claim 1, wherein the control system is configured to determine a state of the first contact and the second contact based on the initial coil voltage data and the updated coil voltage data.

4. The system of claim 1, wherein the control system is configured to send the notification to a computing system in response to the first difference being greater than the first threshold or the second difference being greater than the second threshold.

5. The system of claim 3, wherein the state of the first contact and the second contact is indicative of a weld of the first contact and the second contact.

6. The system of claim 1, wherein the control system is configured to send one or more control signals to one or more other control systems for controlling one or more other switching devices based on the change.

7. The system of claim 6, wherein the control system is configured to:

determine an open timing interval based on the updated coil voltage data; and send the one or more control signals to the one or more other control systems based on the open timing interval.

8. A method, comprising:

receiving, via circuitry, initial coil voltage data corresponding to a back electromotive force (EMF) waveform associated with a coil during a first open operation of a switching device;

receiving, via the circuitry, updated coil voltage data corresponding to the back EMF waveform associated with the coil during a second open operation of the switching device that occurs after a close operation of the switching device that occurred between the first open operation and the second open operation;

determining, via the circuitry, a change between the updated coil voltage data and the initial coil voltage data by:

determining a first difference between a first maximum value associated with the initial coil voltage data and a second maximum value associated with the updated coil voltage data during the first open operation and the second open operation, respectively; and determining a second difference between a first minimum value associated with the initial coil voltage data and a second minimum value associated with the updated coil voltage data during the first open operation and the second open operation, respectively; and sending, via the circuitry, a notification indicative of a state of the switching device to a computing device in response to the first difference being greater than a first threshold and the second difference being greater than a second threshold, wherein the computing device is configured to send a control signal to an additional switching device based on the state of the switching device, wherein the control signal is configured to adjust an open time interval of the additional switching device.

9. The method of claim 8, comprising:

determining whether two contacts associated with the switching device are welded together based on the updated coil voltage data; and updating the notification based on a determination that the two contacts are welded together.

10. The method of claim 8, comprising:

determining an open timing drift based on the change; and send one or more control signals to one or more components based on the open timing drift.

11. The method of claim 8, comprising determining a life expectancy of the switching device based on the change, wherein the notification is indicative of the life expectancy.

12. The method of claim 11, wherein the life expectancy is determined based on a historical record of a second back EMF waveform for a second switching device that corresponds to the switching device.

13. The method of claim 8, comprising:

determining, via the circuitry, an amount of wear sustained by the switching device based on the change; and updating, via the circuitry, the notification based on the amount of wear sustained by the switching device.

14. The method of claim 8, comprising:

determining, via the circuitry, an open timing interval of the switching device based on the updated coil voltage data; and updating, via the circuitry, the notification based on the open timing interval, wherein the computing device is configured to send one or more control signals to one or more additional switching devices based on the open timing interval of the switching device.

15. A non-transitory computer-readable medium comprising computer-executable instructions that, when executed, are configured to cause at least one processor to perform operations comprising:

receiving initial coil voltage data corresponding to a voltage waveform associated with a coil during a first open operation of a switching device;

receiving updated coil voltage data corresponding to the voltage waveform associated with the coil during a second open operation of the switching device that occurs after a close operation of the switching device that occurred between the first open operation and the second open operation;

determining a change between the updated coil voltage data and the initial coil voltage data by:

determining a first difference between a first maximum value associated with the initial coil voltage data and a second maximum value associated with the updated coil voltage data during the first open operation and the second open operation, respectively;

determining a second difference between a first minimum value associated with the initial coil voltage data and a second minimum value associated with the updated coil voltage data during the first open operation and the second open operation, respectively; and sending a notification indicative of a state of the switching device to one or more control systems in response to the first difference being greater than a first threshold and the second difference being greater than a second threshold, wherein the one or more control systems are configured to send one or more control signals to one or more components based on the state of the switching device, wherein the one or more control signals are configured to adjust an open time interval of the one or more components, respectively.

16. The non-transitory computer-readable medium of claim 15, wherein the one or more control signals are configured to cause the one or more components to incorporate one or more delays in one or more operations of the one or more components.

17. The non-transitory computer-readable medium of claim 15, wherein the operations comprise sending a second notification indicative of the change to a computing device.

18. The non-transitory computer-readable medium of claim 17, wherein the operations comprise:

determining a state associated with the switching device based on a comparison of the updated coil voltage data and the initial coil voltage data, wherein the state is associated with one or more contacts that are part of the switching device.

19. The non-transitory computer-readable medium of claim 15, wherein the operations comprise:

determining an amount of wear sustained by the switching device based on the change; and updating the notification based on the amount of wear sustained by the switching device.

20. The non-transitory computer-readable medium of claim 15, wherein the updated coil voltage data is representative of a number of cycles performed by the switching device.

* * * * *